US007802393B2

(12) United States Patent
Judson et al.

(10) Patent No.: US 7,802,393 B2
(45) Date of Patent: Sep. 28, 2010

(54) SOFT-PROJECTILE GUN BARREL AND METHOD FOR MAKING SAME

(75) Inventors: Robert Judson, Richardson, TX (US); Paul Judson, Richardson, TX (US)

(73) Assignee: SJS Paintball, LP, Richardson, TX (US)

( * ) Notice: Subject to any disclaimer, the term of this patent is extended or adjusted under 35 U.S.C. 154(b) by 128 days.

(21) Appl. No.: 12/164,877

(22) Filed: Jun. 30, 2008

(65) Prior Publication Data

US 2009/0007767 A1 Jan. 8, 2009

Related U.S. Application Data

(60) Provisional application No. 60/947,465, filed on Jul. 2, 2007.

(51) Int. Cl.
*F41A 21/20* (2006.01)

(52) U.S. Cl. ..... 42/76.02; 89/14.7; 264/102; 264/299

(58) Field of Classification Search ..... 42/76.01, 42/76.02, 77, 78; 89/14.7, 14.8, 15, 16; 264/101, 264/102, 299, 300, 313, 318, 319; 124/83
See application file for complete search history.

(56) References Cited

U.S. PATENT DOCUMENTS 2,808,623 A * 10/1957 Foster ..... 264/496
2,845,741 A * 8/1958 Day ..... 42/76.01
2,847,786 A * 8/1958 Day et al. ..... 42/76.01
3,517,585 A * 6/1970 Slade ..... 89/16
4,002,714 A * 1/1977 Usui ..... 264/250
4,485,721 A 12/1984 Shankhla et al.
4,622,080 A 11/1986 Wegwerth
4,769,938 A * 9/1988 Chesnut et al. ..... 42/76.02
5,013,507 A * 5/1991 Julien et al. ..... 264/219
5,077,926 A 1/1992 Krumm
5,125,179 A 6/1992 Campbell et al.
5,191,165 A 3/1993 Oskarsson et al.
5,212,328 A 5/1993 Petrovich
5,531,150 A * 7/1996 Gegaregian et al. ..... 89/15
5,590,485 A * 1/1997 Brandl ..... 42/76.02
5,600,912 A 2/1997 Smith
6,637,309 B2 * 10/2003 See et al. ..... 89/16
6,810,615 B2 11/2004 Hermanson et al.
6,823,857 B2 11/2004 Perry et al.
2002/0014148 A1 * 2/2002 See ..... 89/16
2002/0124716 A1 * 9/2002 Grimm et al. ..... 89/14.7
2002/0139240 A1 * 10/2002 See et al. ..... 89/16
2006/0052487 A1 * 3/2006 Cruce et al. ..... 524/2
2008/0120889 A1 * 5/2008 Bose et al. ..... 42/76.02

* cited by examiner

*Primary Examiner*—Benjamin P Lee
(74) *Attorney, Agent, or Firm*—John A. Thomas

(57) ABSTRACT

A method for making a gun barrel for soft projectiles includes providing a mandrel for the bore of the barrel. The mandrel is inserted into a barrel base that can be connected in use to the receiver of a soft-projectile gun. The connected barrel base and mandrel are inserted into a tube. A resin, preferably reinforced, is poured into the space between the inside of the tube and the mandrel. The barrel base, mandrel and tube are surrounded by a pressure chamber. A vacuum is applied to the pressure chamber to de-gas the resin. Then a positive pressure is applied to the pressure chamber to force the tube against the mandrel and resin to form the desired barrel. The mandrel may have rifling impressions. The tube may have a mold shape for forming an ornamental design in the outside of the barrel. Barrels made by the method are also disclosed.

20 Claims, 3 Drawing Sheets

STEP 1
125
120
110
115
130
STEP 2
120
140
110
STEP 3
120
110
STEP 4
120
130
110
STEP 5
150
STEP 6
120
150
130
110
STEP 7
120
130
110
100
180

SOFT-PROJECTILE GUN BARREL AND METHOD FOR MAKING SAME

CLAIM FOR PRIORITY

This application claims the priority of U.S. Provisional Patent Application Ser. No. 60/947,465, titled "Soft-Projectile Gun Barrel and Method for Making Same," filed Jul. 2, 2007.

BACKGROUND

This disclosure relates to guns that propel projectiles using compressed gas as a propellant. More particularly, it relates to an improved gun barrel for use in combination with a gas powered projectile gun firing soft or pliable ammunition such as paint balls or pepper balls. Paint balls have a liquid center covered by a thin plastic or gelatin membrane that maintains the paint ball in an approximately spherical shape. Pepper balls have a powder filled center covered by a thin hard plastic shell that is nevertheless flexible. Both types are called "soft projectiles" in this application. This application incorporates by reference the disclosure of U.S. Patent Publication No. 2005/0247295, titled "Barrel and ball sizer for paint-ball gun," published Nov. 10, 2005.

DRAWINGS

DESCRIPTION

With large-caliber, high-velocity guns there is some risk of the shock of impact with the rifling "stripping" the driving band of the shell. To combat this, some weapons have progressive rifling, in which the rifling grooves start out parallel then gradually increase in twist down the barrel. In barrels for soft-projectile guns, the relationship between the mass and size of the projectile and the propellant force is similar to that in conventional high-velocity cannon.

The gun barrel disclosed here preferably has progressive rifling to cause the rotation of the liquid or powder center of the ball to match the rotation of the outer membrane as the ball leaves the gun barrel. This results in enhanced ball stabilization against tumbling and drift in flight, leading to longer flights and improved accuracy. In other embodiments using the same methods for making, however, the rifling could be non-progressive.

The following table shows an exemplary degree of progressive rotational rifling from the breech of the bore of the barrel (100); here, causing no more than one rotation in 42 inches:

| | |
|---|---|
| First 1 inch | 0 rotation in 42 inches |
| Next inch | 0.1 rotation in 42 inches |
| Next inch | 0.2 rotation in 42 inches |
| Next inch | 0.3 rotation in 42 inches |
| Next inch | 0.4 rotation in 42 inches |
| Next inch | 0.5 rotation in 42 inches |
| Next inch | 0.6 rotation in 42 inches |
| Next inch | 0.7 rotation in 42 inches |
| Next inch | 0.8 rotation in 42 inches |
| Next inch | 0.9 rotation in 42 inches |
| Next inch | 1.0 rotation in 42 inches |

Figure 1A:
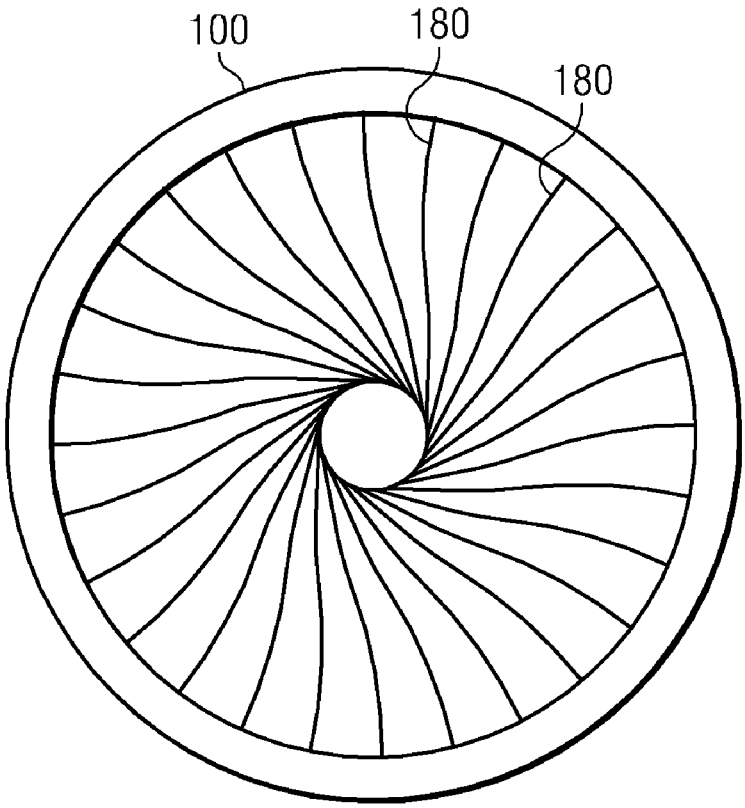
FIG. 1 depicts exemplary progressive rifling in a gun barrel.
Figure 1B:
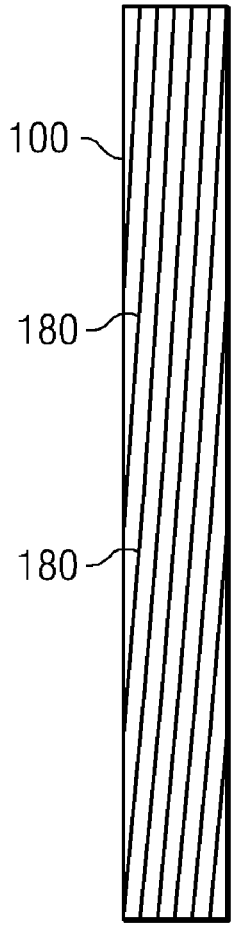

FIG. 1 is a graphical representation of the progressive rifling set out in the foregoing table. FIG. 1A is a view into the barrel and FIG. 1B is a graphical representation of a twist.

Figure 2:
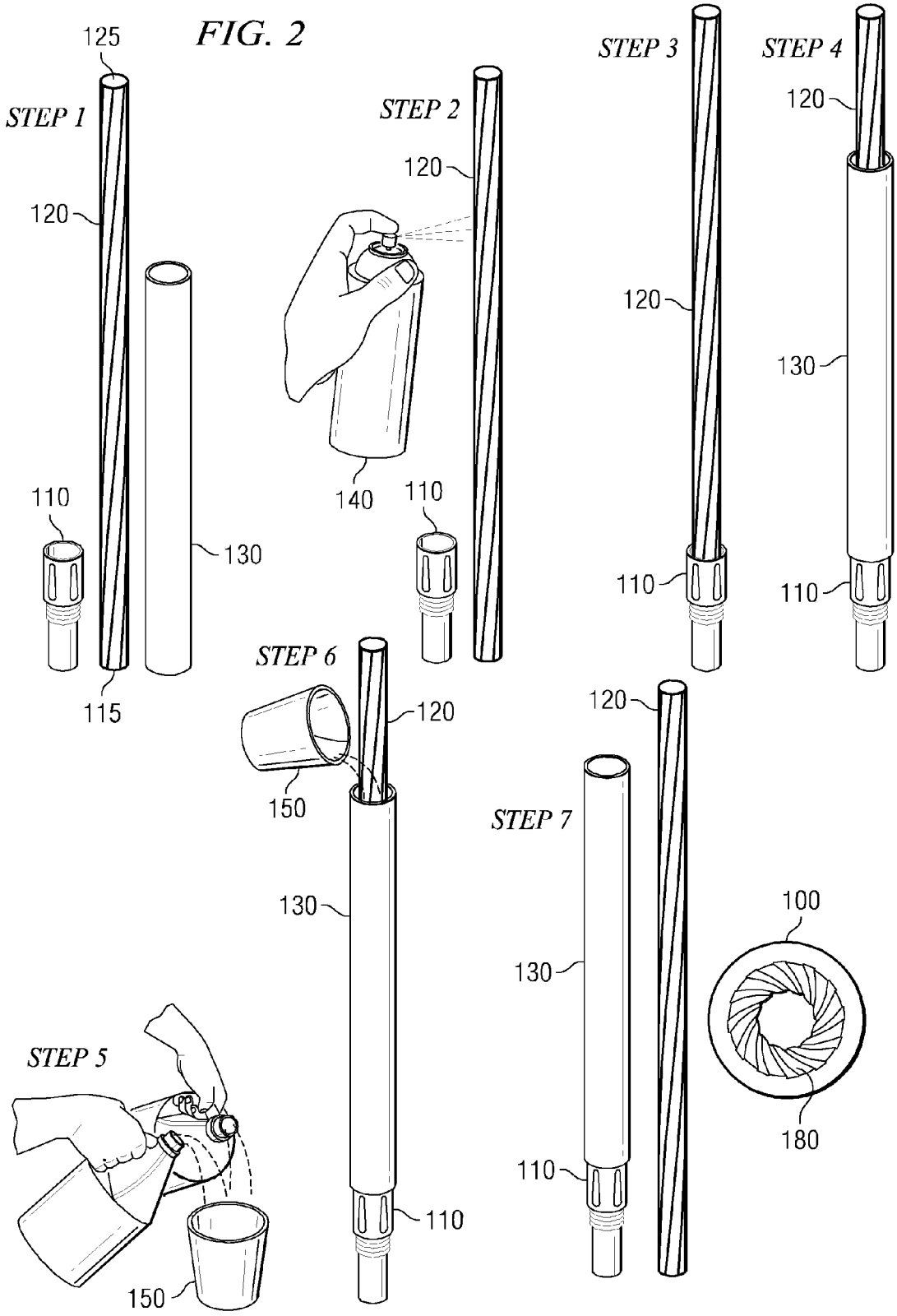
FIG. 2 depicts a method of making such a gun barrel.

FIG. 2 shows apparatus and methods for making a soft-projectile gun barrel, where the barrel is substantially made of a plastic, perhaps reinforced internally. Suitable materials are most thermoplastics, such as polyurethane, polycarbonates, such as LEXAN, from the GE Plastics Company, acrylics, or ABS varieties. Reinforcing materials could include powdered metals such as aluminum or iron, carbon fibers, or fiberglass.

In Step 1 of FIG. 2, a barrel base (110) has been prepared. The barrel base (110) is typically of metal and machined to engage to newly-formed barrel (110) at a first end, and a ball sizer (not shown) or the receiver (not shown) of a soft-projectile gun at its opposite or second end. The barrel base (110) would typically have threads for engaging a ball sizer or receiver in its second end. Step 1 shows a rifled mandrel (120) for forming the bore of the barrel (100), prepared by machining or casting to form the rifling impressions in the completed barrel (100). As shown the mandrel (120) has a breech end (115) and a muzzle end (125). Step 1 also shows a tube (130) of metal or composite material that is inserted over the mandrel (120). The tube (130) may have a mold shape in its inner surface to impress an ornamental design (105) into the barrel (100), so that the outer surface of the barrel (100) is formed into the ornamental design (105).

Step 2 shows the mandrel (120) sprayed with a conventional release agent (140), suitable for releasing the formed barrel (100), depending on the composition of the resin (150).

Step 3 shows the mandrel (120) inserted into the barrel base (110).

Step 4 shows the mandrel (120) and base (110) assembly inserted into the tube (130).

Step 5 shows the mixing of a preselected resin (150). "Resin" is here taken to mean any suitable compound for molding the barrel (100).

Figure 3:
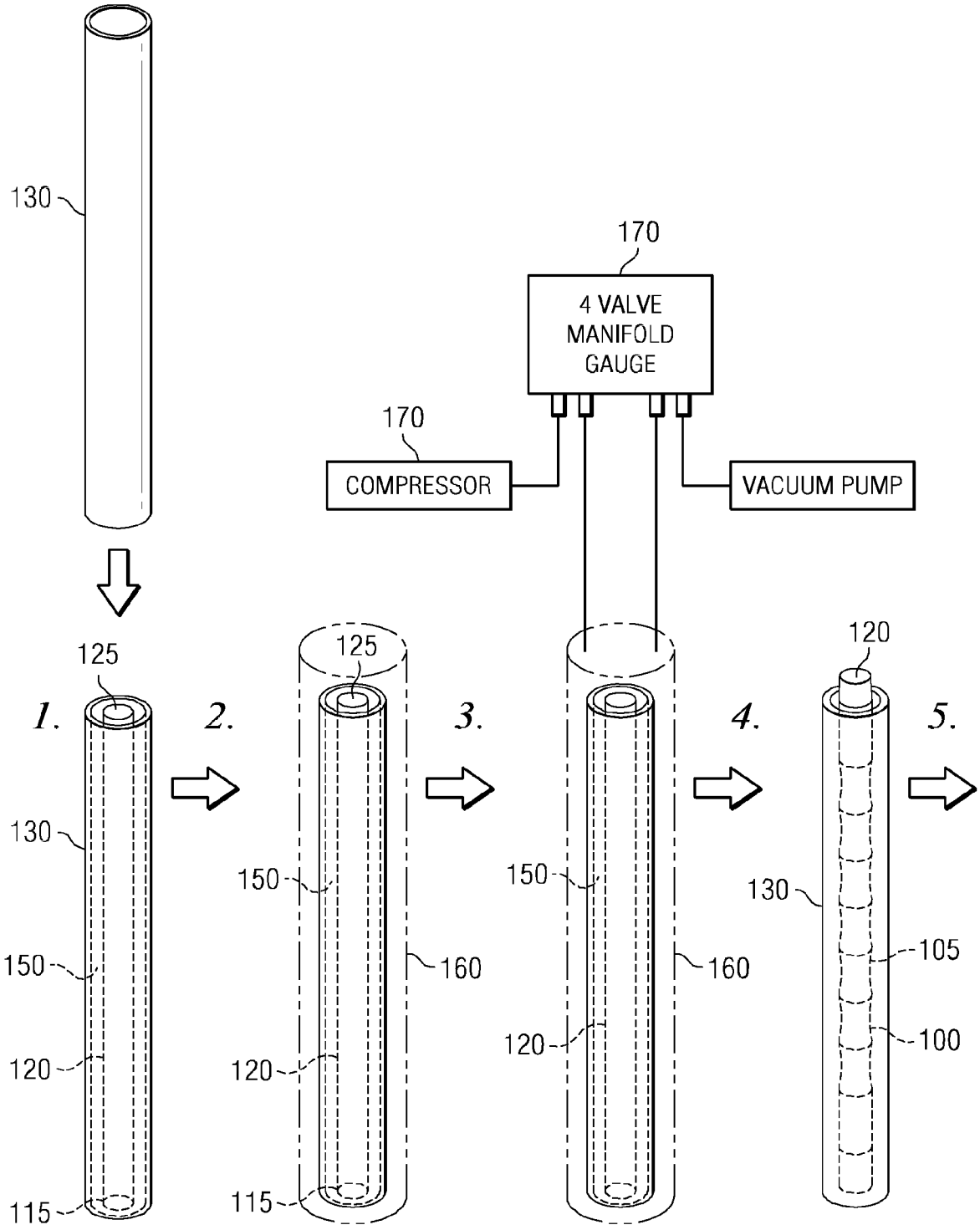
FIG. 3 depicts further details of the making of such a gun barrel.

Step 6 shows the resin (150) poured into the space between the mandrel (120) and the tube (130). Step 6 is further depicted in FIG. 3, showing a pressure chamber (160) surrounding the tube (130). The pressure chamber (160) is connected to a pressure apparatus (170) capable of supplying vacuum or positive pressure to the pressure chamber (160). Preferably, the pressure chamber (160) is held at a vacuum (approximately 29 inches of mercury or less) for several minutes to de-gas the resin (150) and eliminate bubbles. Then positive pressure is applied to form the barrel between the tube (130) and the mandrel (120). A positive pressure of approximately 60 p.s.i. is generally sufficient.

Step 7 in FIG. 2 shows the tube (130) with the mandrel (120) removed, and also a view of the internal rifling (180) thus formed in the set resin (150). The tube (130) is then removed and the newly-formed barrel (100) with outer ornamental design (105) and internal rifling (180) is revealed. See FIG. 3.

We claim:

1. A method for making a gun barrel for soft projectiles comprising:

providing a mandrel for the bore of the gun barrel;

providing a barrel base;

inserting the mandrel into the barrel base;

inserting the barrel base and mandrel into a tube;

pouring a resin into a space between the mandrel and the tube;

surrounding the tube, mandrel and barrel base with a pressure chamber;

connecting the pressure chamber to a pressure apparatus capable of selectively providing vacuum or positive pressure to the pressure chamber;

using the pressure apparatus to provide a vacuum to the pressure chamber sufficient to de-gas the resin; and using the pressure apparatus to provide a positive pressure to the pressure chamber sufficient to form the gun barrel between the tube and the mandrel, so that the barrel base is fixed to the gun barrel thereby formed.

2. The method of making a gun barrel for soft projectiles of claim 1, further comprising the vacuum being a pressure of about 29 inches of mercury.

3. The method of making a gun barrel for soft projectiles of claim 1, further comprising the positive pressure being approximately 60 p.s.i.

4. The method of making a gun barrel for soft projectiles of claim 1, further comprising providing rifling impressions in the mandrel.

5. The method of making a gun barrel for soft projectiles of claim 4, further comprising the rifling impressions on the mandrel being progressive rotational rifling.

6. The method of making a gun barrel for soft projectiles of claim 5, further comprising:

the mandrel having a breech end and a muzzle end; and where the progressive rifling on the mandrel increases, moving from the breech end to the muzzle end, from zero rotations per 42 inches of forward movement of a projectile to one rotation per 42 inches of forward movement of the projectile at a rate of 0.1 rotation per 42 inches of forward movement of the projectile per inch of mandrel.

7. The method of making a gun barrel for soft projectiles of claim 1, further comprising the resin being a thermoplastic.

8. The method of making a gun barrel for soft projectiles of claim 7, further comprising the thermoplastic being internally reinforced.

9. The method of making a gun barrel for soft projectiles of claim 8, further comprising the thermoplastic being internally reinforced with at least one of a powdered metal, carbon fibers or fiberglass.

10. The method of making a gun barrel for soft projectiles of claim 1, further comprising the tube being made of a metal.

11. The method of making a gun barrel for soft projectiles of claim 1, further comprising:

providing a mold shape in the inner surface of the tube so as to form an ornamental design into the barrel when the positive pressure is applied.

12. The method of making a gun barrel for soft projectiles of claim 1, further comprising the mandrel being sprayed with a release agent prior to the resin being poured into the space between the mandrel and the tube.

13. A gun barrel for soft projectiles made according to the method of claim 1.

14. A gun barrel for soft projectiles made according to the method of claim 2.

15. A gun barrel for soft projectiles made according to the method of claim 3.

16. A gun barrel for soft projectiles made according to the method of claim 4.

17. A gun barrel for soft projectiles made according to the method of claim 5.

18. A gun barrel for soft projectiles made according to the method of claim 6.

19. A gun barrel for soft projectiles made according to the method of claim 7.

20. A gun barrel for soft projectiles made according to the method of claim 11.

* * * * *